US005207160A

United States Patent [19]

Harada

[11] Patent Number: 5,207,160

[45] Date of Patent: May 4, 1993

[54] METHOD AND APPARATUS FOR CLEANING PRINTING CYLINDER

[75] Inventor: Matsuo Harada, Tokyo, Japan

[73] Assignee: Nikka Kabushiki Kaisha, Tokyo, Japan

[21] Appl. No.: 747,735

[22] Filed: Aug. 20, 1991

[30] Foreign Application Priority Data

Aug. 20, 1990 [JP] Japan ..... 2-218777

[51] Int. Cl.[5] ..... B41F 35/00

[52] U.S. Cl. ..... 101/425; 101/423

[58] Field of Search ..... 101/425, 423; 15/38

[56] References Cited

U.S. PATENT DOCUMENTS

| | | | |
|---|---|---|---|
| 150,725 | 5/1874 | Spaulding | 15/38 |
| 2,291,991 | 8/1942 | Spraker | 101/425 |
| 2,751,616 | 6/1956 | Turner, Jr. et al. | 101/425 |
| 3,309,993 | 3/1967 | Grembecki et al. | 101/425 |
| 3,735,702 | 5/1973 | Kossak | 101/425 |
| 3,763,778 | 10/1973 | Sills et al. | 101/483 |
| 4,015,307 | 4/1977 | Kossak | 15/256.52 |
| 4,704,963 | 11/1987 | Nishimura et al. | 101/425 |
| 4,972,780 | 11/1990 | Gasparrini et al. | 101/217 |
| 5,010,819 | 4/1991 | Uribe et al. | 101/425 |
| 5,086,701 | 2/1992 | Gasparrini et al. | 101/425 |

OTHER PUBLICATIONS

Eide et al., "Cleaner to Developer Toner Recirculation", IBM Technical Disclosure Bulletin, vol. 21, No. 5, Oct. 1978.

Bresnick, "Vacuum-less cleaning and reclaim sys. for magnetic tone/media", Xerox Disclosure Journal, vol. 5, No. 4, Jul./Aug. 1980.

Barisone et al., "Brush Cleaner-Contoured-Air Flow Baffles", Xerox Disclosure, vol. 4, No. 3, May/Jun., 1979.

Richert et al., "Xerographic Cleaning Station", IBM Technical Disclosure Bulletin, vol. 25, No. 1, Jun. 1982.

*Primary Examiner*—Edgar S. Burr
*Assistant Examiner*—Anthony H. Nguyen
*Attorney, Agent, or Firm*—McAulay Fisher Nissen Goldberg & Kiel

[57] ABSTRACT

The present invention relates to a novel method and apparatus for cleaning off the ink sediment and paper powder and the like which adhere to a cylinder such as a blanket cylinder in a printing machine, without using any cleaning solution. A brush roll rotated by an independent rotational driving source is brought into contact with a blanket cylinder during printing. The brush roll has many brush fibers which are planted in the outer periphery thereof and which are bent at the ends thereof so as to have a combing function. This is realized by bending the brush fibers in zigzags. It is preferable that the rotational directions of the blanket cylinder and the printing cylinder are opposite to each other, and the relative rotational speed is set to 5 to 12 m/s. The dry brush roll is surrounded by a casing in which a scraper for removing dust from the brush fibers and a dust collecting portion are provided, or to which negative pressure function means is connected so that the dust can be easily removed. Since the dust removed contains no organic solvent, it can be easily handled.

6 Claims, 6 Drawing Sheets

METHOD AND APPARATUS FOR CLEANING PRINTING CYLINDER

BACKGROUND OF THE INVENTION

I. Field of the Invention

The present invention relates to a method and apparatus for cleaning a printing cylinder, and particularly to a method and apparatus for dry-cleaning the surface of a printing cylinder such as a blanket cylinder or the like.

The surfaces of printing cylinders, particularly blanket cylinders, are generally periodically cleaned because ink sediment and paper powder adhere to the surfaces.

II. Description of The Prior Art

In conventional cleaning methods, the surface of a blanket cylinder is wet-cleaned by using a brush roll impregnated with a cleaning fluid (Japanese Patent Publication No. 44-2166), or a cleaning fluid is sprayed on a contact portion of the surface of a blanket cylinder on which a cleaning sheet is pressed so that the surface is cleaned by relative rotation between the sheet and the blanket cylinder. These are all wet cleaning methods using as a cleaning fluid, a solvent which has affinity for ink and which is impregnated in a brush or sheet for cleaning the surface of a blanket cylinder.

In the conventional cleaning methods, organic solvents must frequently be used for obtaining higher detergency, dangerous substances the use of which is limited by legislation. In addition, since the use of these dangerous substances is restricted from the viewpoint of equipment, the substance is sometimes mixed with flon or the like to lower the flash point and make it less dangerous to handle. However, because of its environmental impact, it is more difficult and may be become impossible to use flon. The disposal of the cleaning fluid, the waste solutions and cleaning sheets impregnated with solvent or the like is therefore a critical problem.

However, methods for cleaning printing cylinders without a solvent for dissolving ink and then wiping off the ink have not been achieved because of the fixed idea that an organic solvent having affinity for the ink must be used for removing ink setoff ad paper powder in tee printing field.

In addition, since the cylinder must be dried after cleaning because the cleaning fluid adheres to the surface of the blanket cylinder, wiping means accompanying the cleaning means must also be provided. Further, an apparatus and equipment must be provided for supplying the cleaning fluid to a brush, a belt and so on. Thus a problem arises with respect to the large space required for the cleaning equipment.

In the case of continuous printing, since printing is not done while supplying paper during a cleaning time, the printing paper passed through the printing cylinder during this time must be discarded as broke. A conventional cleaning method requires at least several minutes or more resulting in discard of may sheets of printing paper as broke. With recent high-speed printing systems the number of broke sheets to be discarded during cleaning is increased.

In addition, the use of a cleaning fluid sometimes causes the cleaning fluid to flow into the inside (rear side serving as a non-printing side) of the blanket through the side or end of the blanket cylinder regardless of whether manual or mechanical cleaning is used. The inside of the blanket is swollen with the cleaning fluid flowing in the inside because the bonded internal surface of the blanket cylinder is generally easily affected by an organic solvent. This frequently results in an increase in the thickness of the blanket and thus abrasion of the print surface, thereby producing a stain on a print. The swelling of the inside of the blanket with a cleaning fluid also causes the problem that the life of the blanket is decreased due to the occurrence of high contact pressure between the blanket and an impression cylinder.

SUMMARY OF THE INVENTION

It is a first object of the present invention to dry-cleaning a printing cylinder such as a blanket cylinder or the like without using any cleaning liquid.

It is a second object of the present invention to provide a cleaning method and apparatus which are capable of cleaning within a very short time during printing so as to decrease the number of broke sheets.

These objects are achieved by a method of cleaning a printing cylinder in accordance with the present invention wherein a dry brush roll rotated by an independent rotational driving source is brought into rotational contact with a cylinder such as blanket cylinder or the like, which is rotated during printing and on which printing paper is passed, wherein the dry brush roll and the cylinder are rotated in opposite directions, and the relative rotational speed therebetween is kept at a high value so that a substance adhering to the surface of the printing cylinder is separated and cleaned off in a dry manner. In this case, the drying brush roll contacting with the cylinder is bent at least at the ends of brush fibers so that a combing effect takes place on the surface of the cylinder. In addition, the relative rotational speed between the dry brush roll and the printing cylinder is set to 5 to 12 m/s.

An apparatus for cleaning a printing cylinder in accordance with the present invention comprises a dry brush roll which can be moved so as to contact with and separate from a printing cylinder and which has brush fibers planted therein and having bent ends which contact with the surface of the cylinder; and an independent rotational driving source for rotating the dry brush roll; wherein the dry brush roll is enclosed with a casing in which a scraper engaged in the dry brush roll and a portion for collecting dust removed by the scraper are provided. In this arrangement, the brush fibers of the dry brush roll are buckled and bent in zigzags. In addition, the dust collecting portion provided in the casing is connected to suction means. If required, a filter may be provided in the dust collecting portion in the casing so that the dust collecting portion is connected to the suction means through the filter.

DESCRIPTION OF THE PREFERRED EMBODIMENTS

In the above-described arrangement, the dry brush roll rotated in the direction opposite to the rotational direction of the printing cylinder such as the blanket cylinder or the like is brought into contact with the blanket cylinder rotated, the rotational directions of both members being opposite to each other, and the relative rotational speed being kept at a high set value. In this way, the contact between the cylinder and the dry brush roll, both of which are rotated at high speed, causes the ink and paper powder which adhere to the surface of the cylinder to be separated and removed. The method therefore has sufficient cleaning function even if no cleaning liquid is used.

Figure 8:
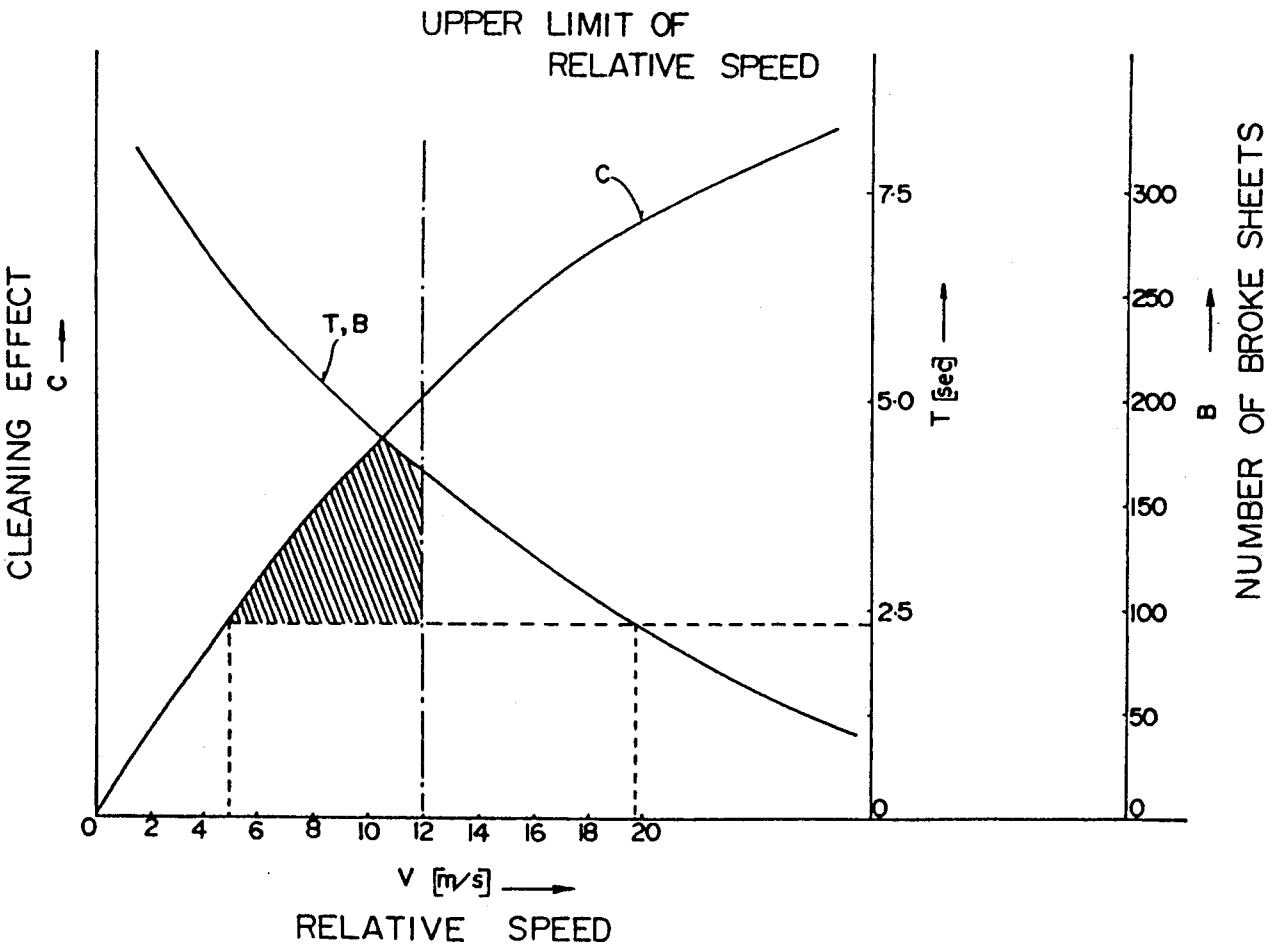
FIG. 8 is a drawing showing the relation of the cleaning effect to the relative rotational speed between a blanket cylinder and a brush roll.

In this case, when the relative circumferential speed between the printing cylinder and the brush roll was kept at a constant value within the range of 5 to 12 m/s, a significant cleaning effect was obtained, and a dry-cleaning effect was confirmed. Namely, the relative speed v between the printing cylinder, particularly the blanket cylinder, and the cleaning brush, which is shown on the abscissa, and the cleaning effect have a substantially proportional relation, as shown by curve C in FIG. 8. This is because the cleaning force is increased as the difference between the speeds of both members is increased. In addition, the relative speed v and the cleaning time have the relation that the cleaning time is decreased as the relative speed is increased because the cleaning force is increased as the speed difference is increased, as shown by curve T in FIG. 8. Further, the relation between the number B of broke sheets and the relative speed v is similar to the relation between the cleaning time T and the relative speed v, and the region under both curves T, B is a region required for obtaining a necessary cleaning effect. However, since the highest speed of a printing machine is generally limited at 12 m/s, the upper limit speed is 12 m/s. The relative speed lower limit of 5 m/s is required for obtaining at least a predetermined level of cleaning effect. It is therefore preferable that a necessary relative speed is within the range of 5 to 12 m/s.

In addition, since the brush fibers have a structure in which at least the ends thereof are bent and are rotated, the ends of the brush fibers enter the portion between the cylinder surface and the ink and paper powder which adhere thereto, and the brush fibers have the combing effect. The cleaning apparatus thus exhibits a positive separating and cleaning function and high detergency in dry cleaning.

Further, since the cleaning apparatus allows the dry brush roller to be rotated by the independent rotational driving means, the rotational speed difference between the brush roll and the cylinder is kept at a constant high value so that ink or the like is effectively cleaned off by the brush fibers. Although the ink and paper powder which are separated by the dry brush roll enter spaces between the respective brush fibers and adhere to the fibers, they are removed by the scraper provided in the casing and collected by the dust collecting portion in the casing. The dust can be removed by suction by the suction means connected to the dust collecting portion and collected by a dust-collecting bag separately provided. When a filter is provided in the collecting portion, dust can be collected directly in the casing and discarded together with the filter.

Since the brush fibers of the dry brush roll are buckled fibers which are bent in zigzags, the contact pressure between the cylinder and the brush roll can be kept constant. In addition, since the brush fibers are planted at random so that the bent ends of the fibers are directed in all directions, the brush fibers enter the portion between the cylinder and the substances which adhere thereto regardless of the relative movement between the brush fibers and the cylinder so as to have a large separating function. At the same time, it is possible to prevent nonuniformity from occurring due to the partial crinkle or the brush fibers.

The dry cleaning achieved by using the above dry brush roll enables a decrease in the time required for cleaning to several seconds because no cleaning fluid is discharged, and need not be wiped off. As a result, the time required during when printing is stopped can be significantly decreased. This permits a significant decrease in the number of broke sheets which are produced as unprinted paper during continuous sprinting. The cleaning method and apparatus provide a high printing efficiency even when used for a high-speed printing apparatus, and avoid problems with environmental pollution since cleaning solvent is not discharged as a waste liquid.

The method and apparatus for cleaning a printer cylinder configured as described above does not require an organic solvent for dissolving ink, and are capable of separating and removing, in a dry manner, the ink and paper powder, which adhere to the printing cylinder, in a very short time, with substantially no effect on the printing work. It was found that the cleaning method using the dry brush roll is particularly effective when applied to a printing apparatus for printing newspaper which produces a large amount of paper powder adhering to the apparatus. In addition, since organic solvents, e.g., flon or the like or dangerous substances as legally defined are no used, the inventive cleaning method and apparatus avoid all problems with respect to the disposal of a waste liquid, the occurrence of environmental pollution and the like. The nonuse of such a solvent or dangerous substances also has the effect of causing the method and apparatus to be socially allowed as a very simple cleaning system.

Embodiments of a method and apparatus for cleaning a printing cylinder in accordance with the present invention are described in detail below with reference to the drawings.

Figure 1:
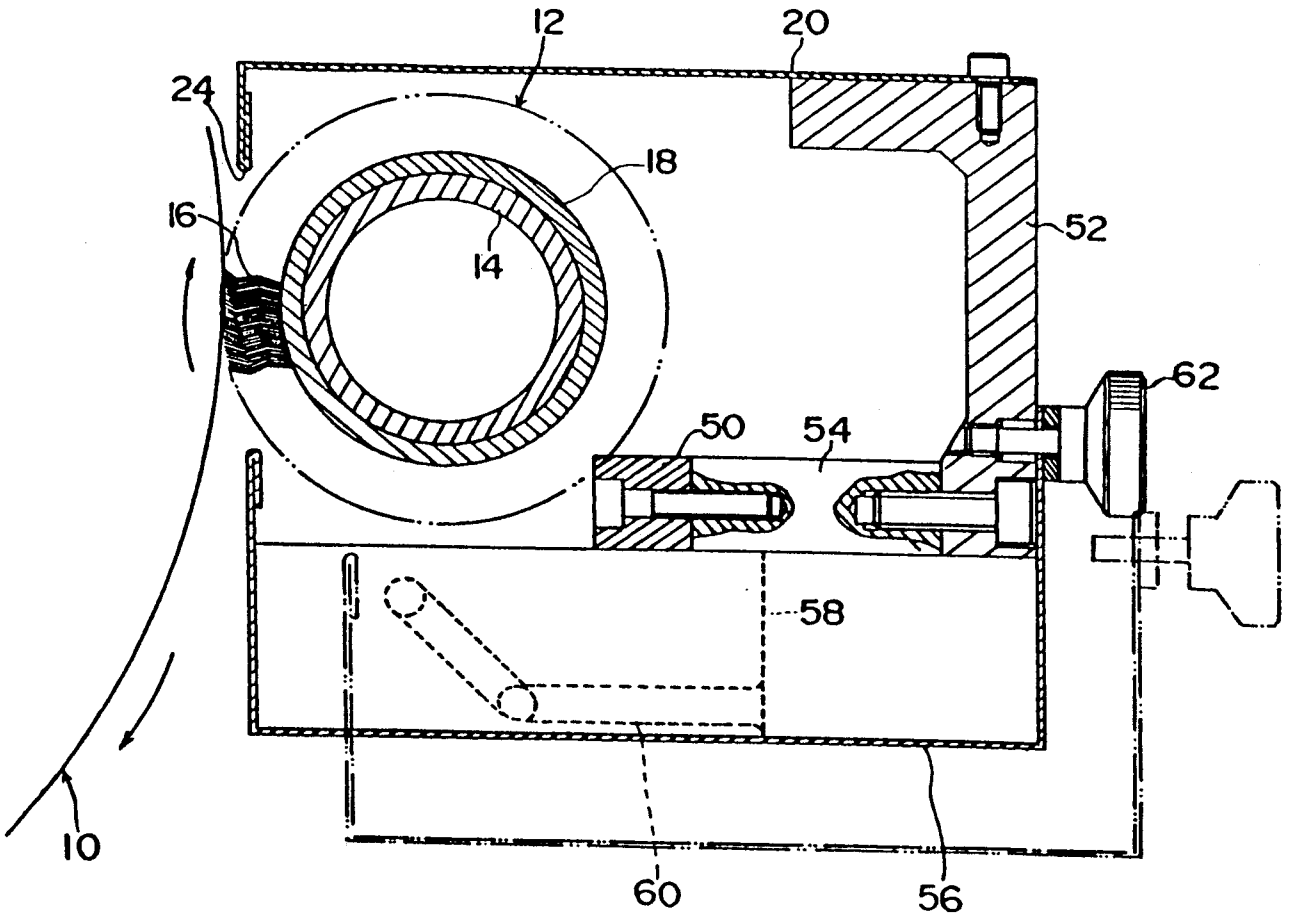
FIG. 1 is a sectional view of a cleaning apparatus in accordance with an embodiment of the present invention.
Figure 2:
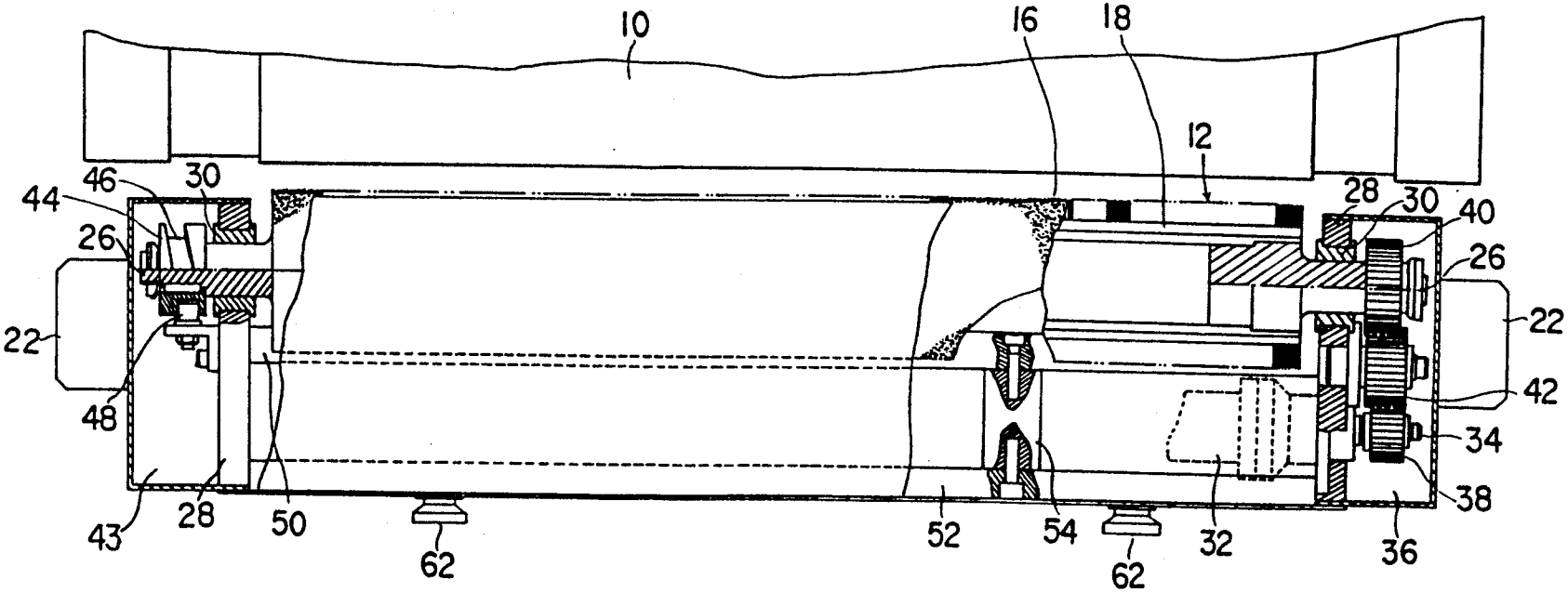
FIG. 2 is a partially broken-out plan view of the same apparatus.
Figure 3:
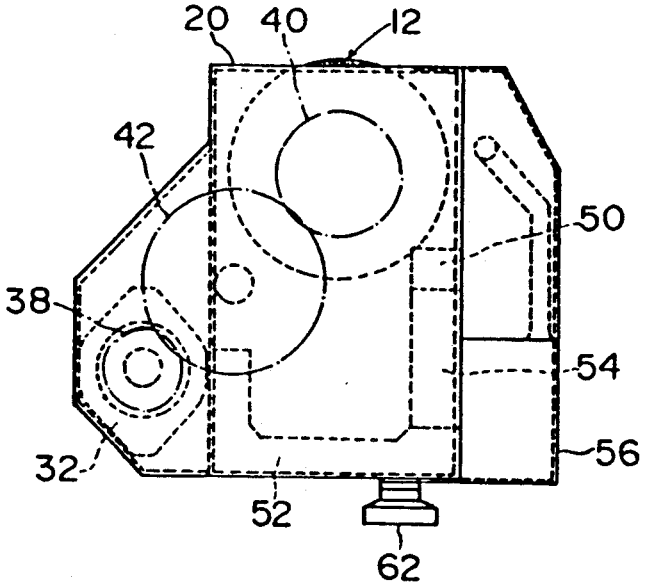
FIG. 3 is a side of the apparatus shown in FIG. 2.

FIGS. 1 and 2 show an apparatus for cleaning a printing cylinder in accordance with an embodiment. This cleaning apparatus is designed for cleaning a blanket cylinder 10 serving as a printing cylinder and comprises a dry brush roll 12 which can be forwardly and backwardly moved with respect to the blanket cylinder 10. The brush roll 12 comprises a cylindrical roll core 14 and a ground fabric 18 in which brush fibers 16 are planted and which is integrally bonded to the outer periphery of the core 14. Each of the brush fibers 16 of the dry brush roll 12 is made of a nylon fiber having a diameter of about 0.2 to 0.3 mm and is buckled, as shown in FIG. 3. Namely, the brush fibers 16 are bent in zigzags and planted in the ground fabric 18 so as to be inclined in all directions. The brush fibers 16 which are directed opposite to the rotational direction of the blanket cylinder 10 in every portion thereof are formed so as to scratch and slide on the surface of the blanket cylinder 10 and bend in the lengthwise direction of the fibers when contacting with the blanket cylinder 10. The dry brush roll 12 having the buckled brush fibers 16 planted therein has a roll length which is substantially the same as that of the blanket cylinder to be cleaned and is provided on a casing 20 so that it can be moved in the direction of separation from and contact with the blanket cylinder 10 while rotating.

The casing 20 is a box container for containing the brush roll 12, and guide plates 22 provided on the both side plates thereof are passed through a base (not shown) so that the casing 20 can be moved in the direction of approach to or separation from the blanket cylinder 10 by operating means (not shown) through the guide plates 22. The casing 20 has a window 24 formed on the front side thereof facing the blanket cylinder 10 so that part of the brush roll 12 involved in the casing 20 can be projected from the window 24. Rotational shafts 26 are provided at both ends of the brush roll 12 and passed through the end plates 28 provided at both sides of the casing 20 through bearings 30. For example, an air motor 32 for rotating the brush roll 12 is provided on one of the end plates 28 of the casing 20 so as to be placed in a room separating from the casing 20 behind the brush roll 12, the output shaft 34 of the motor 32 being passed through the end plate 28. In this case, as a matter of course, rotational driving means such as an electric motor or the like may be used in place of the air motor 32. The room enclosed by one of the end plates 28 and the casing side plate serves as a gear box 36 in which gears 38, 40 are respectively provided on the motor output shaft 34 and the roll rotational shaft 26 and connected to each other through an intermediate gear 42 so as to rotate the brush roll 12. The room enclosed by the other end plate 28 and the casing side plate serves as a cam containing room 43 in which a cylindrical cam 44 is provided on the roll rotational shaft 26 projected therein, and a cam roller 48 engaged with the cam groove 46 formed in the outer periphery of the cylindrical cam 44. The cam groove 46 is formed along a surface at an angle to the roll shaft so that the brush roll 12 itself can be axially reciprocated by the rotation thereof.

A scraper 50 is also installed in the casing 20 so as to be engaged in the brush of the brush roll 12. The scraper 50 is formed by a square bar having a length which is at least equal to the length of the brush roll 12. The scraper 50 is disposed in parallel with the roll 12 under the brush roll 12 so that the upper corner portion thereof is overlapped the surface of the brush roll 12 and engaged therein. The scraper 50 is therefore brought into rotational contact with the brush roll 12 in a state where the corner is engaged in the surface of the brush so as to swat off the dust adhering to the brush fibers 16. The scraper 50 is securely held by a frame 52 of the casing 20 through a plurality of spacers 54.

On the other hand, the lower portion of the casing 20 serves as a cassette container 56 which is detachable from the upper casing portion. This cassette container 56 serves as a dust collecting container for collecting paper powder, ink sediment and the like, all of which are separated and cleaned off from the surface of the blanket cylinder 10 by the brush roll 12, entrapped in the casing 20 and swatted off by the scraper 50. The dust collecting cassette container 56 can be detached from the upper casing 20 by obliquely and downwardly moving the casing 20 from the assembly state thereof and then backwardly moving the casing 20 along the attachment guides 60 formed in the guide plates 58 downwardly extended from the end plates 28 of the upper casing 20. A set screw 62 for fixing the container 56 to the upper casing 20 is provided on the rear side of the container 56 so that the casing 20 is assembled by the tightening the set screw 62 to the frame 52.

In the cleaning apparatus configured as described above, substances such as ink, paper powder and the like, which adhere to the surface of the blanket cylinder 10, are separated and cleaned off by bringing the dry brush roll 12 into rotational contact with the surface. During the operation of a printing apparatus, the blanket cylinder 10 is rotated at 500 to 600 rpm. When the air motor 32 is started before the start of the cleaning work, the brush roll 12 is rotated at a constant rotational speed within the rage of 100 to 150 rpm in the direction opposite to the rotational direction of the blanket cylinder 10. As a result, the relative peripheral speed at the portion of contact between the blanket cylinder 10 and the brush roll 12 is set to 5 to 12 m/s. The casing 20 is then forwardly moved toward the surface of the blanket cylinder 10 rotated so that the surface of the brush roll 12 partially projected from the window 24 is put into contact with the cylinder 110.

Figure 4:
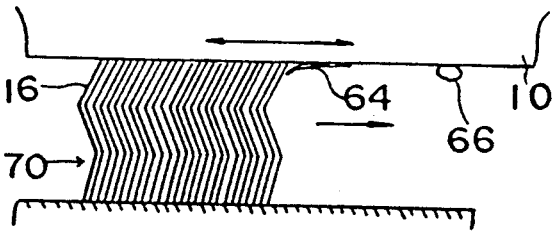
FIGS. 4 and 5 are explanatory views showing the state wherein brush fibers are planted.
Figure 5:
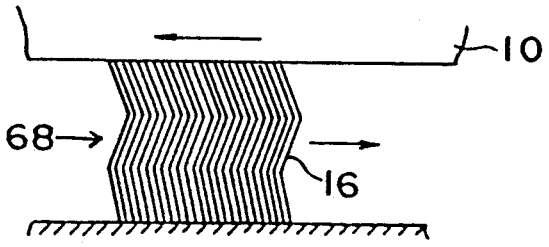

Since the brush fibers 16 secured in the brush roll 12 are made of buckled fibers, as described above, and have inclined ends which are directed in all directions with respect to the surface of the blanket cylinder 10, as shown in FIGS. 4 and 5 (although the inclined ends are aligned in the example shown in the drawings, the inclined ends are in fact directed at random), the brush fibers 16 have the combing function to enter the portion between the blanket cylinder 10 and the ink 64 and paper 66 which adhere to the surface thereof and separate the ink 64 and paper powder 66 from the blanket cylinder 10, thereby separating and removing the substances adhering to the surface of the blanket cylinder 110 therefrom.

The substances separated and cleaned off from the cylinder 10 enter portions between the brush fibers 16 of the brush roll 12, are swatted off the fibers 16 by the scraper 50 and then contained in the lower portion of the casing 20. After a predetermined number of cleaning cycles have been completed, the cassette container 56 containing the dust is detached by backwardly moving the casing 20, and the ink sediment and paper powder contained therein are discarded.

The above-described inventive dry cleaning using the the dry brush roll 12 does not require wiping off of cleaning liquid from the blanket cylinder 10 and thus significantly decreases the cleaning time because no cleaning solvent is used. Experiments showed that the cleaning time to attain a cleaning level equivalent to that attained with a cleaning fluid is only 2 to 5 seconds, as compared with the necessary cleaning time of 3 to 6 minutes using a conventional cleaning apparatus. It was therefore possible to significantly decrease the number of unprinted broker sheets produced during cleaning as compared with conventional wet cleaning methods. It was thus confirmed that the cleaning apparatus of the invention is effectively applied to high-speed continuous printing machines for printing newspaper. Particularly, since the above embodiment employs a dry cleaning method and thus requires no mechanism for supplying a cleaning liquid and mechanism for discharging the waste cleaning liquid, the embodiment decreases the complexity and size of the cleaning apparatus.

On the other hand, since the brush fibers 16 are made of buckled fibers having elasticity in the lengthwise direction thereof, the directions of the fiber ends are unchanged even if the contact pressure with the blanket cylinder 10 is increased. The separating function of the brush fibers 16 can be thus maintained even if the contact state is changed. The elasticity of the brush fibers 16 minimizes changes in shape of the fibers during long-term use. When straight fibers are planted in the brush roll so as to be inclined at predetermined angles in place of the buckled fibers, the basic cleaning effect is obtained.

Figure 6:
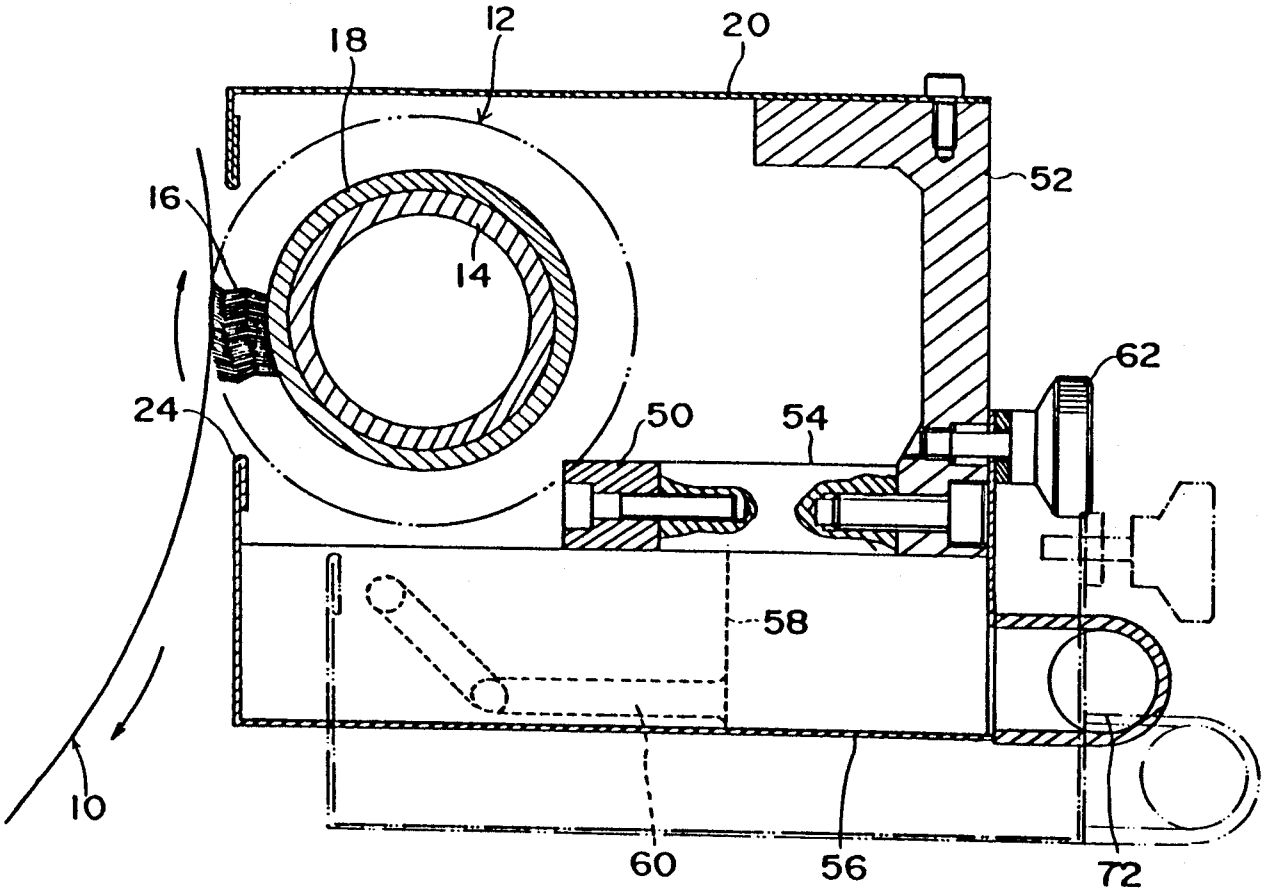
FIG. 6 is a sectional view of a cleaning apparatus in accordance with a second embodiment of the present invention.

FIG. 6 shows a cleaning apparatus in accordance with a second embodiment. In the apparatus, the ink and paper powder separated and cleaned off the blanket cylinder 10 are discarded by suction through the casing 20. The arrangement of the second embodiment is the same as that of the first embodiment with the exception that a suction pipe 72 connected to a suction blower (not shown) is connected to the cassette container 56. The same members are denoted by the same reference numerals and are not described below.

In the second embodiment configured as described above, although the ink and paper powder which adhere to the brush roll 12 are removed by the scraper 50 in the casing 20 during separation cleaning, the substances are collected from the cassette container 56 by an external bag filter or the like through the suction pipe 72. The second embodiment thus prevents the paper powder and so on which are removed from the brush roll 12 by the scraper 50 in the casing 20 to be blown up and scattered to the outside through the window by rotation of the brush roll 12. The embodiment has an excellent effect of collecting dust.

Figure 7:
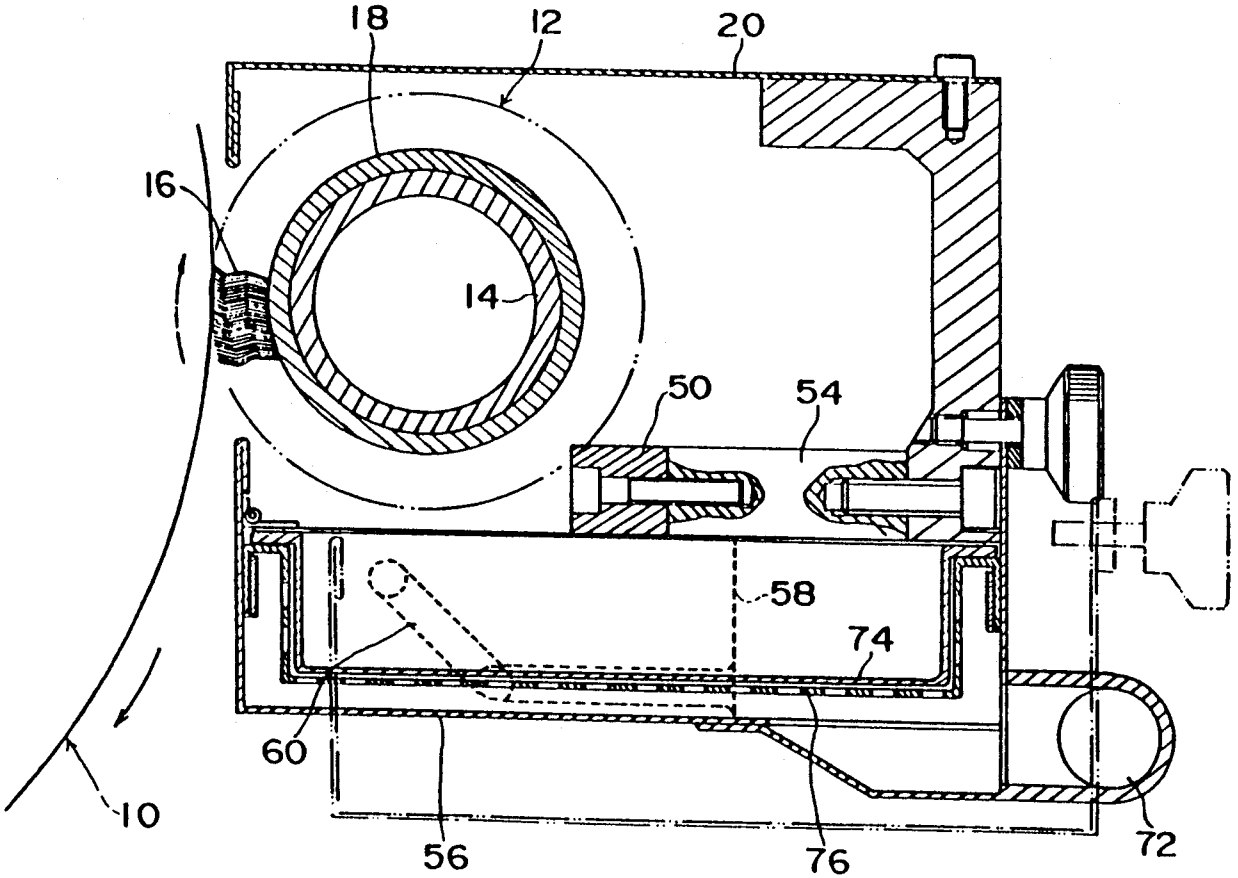
FIG. 7 is a sectional view of a cleaning apparatus in accordance with a third embodiment of the present invention.

FIG. 7 shows a cleaning apparatus in accordance with a third embodiment. Although the third embodiment is the same as the second embodiment in the point that a suction pipe 72 is connected to the cassette container 56, a filter 74 is further provided on the internal surface of the cassette container 56 so as to collect paper powder and so on in the cassette container 56. A panting plate 76 for forming a gap is provided on the internal surface of the cassette container 56 for the purpose of securing an appropriate collecting area, the filter 74 being placed on the internal surface of the panting plate 76.

In the third embodiment, the ink and paper powder which are moved from the brush roll 12 by the scraper 50 are sucked by the suction blower connected to the cassette container 56 and then collected on the internal surface of the filter 74. After a predetermined number of cleaning works have been completed, the cassette container 56 is separated so that the filter provided on the internal surface of the cassette container 56 with the collected dust wrapped therein can be discarded at it was. The third embodiment thus has the effect of facilitating disposal of dust.

Although the blanket cylinder 10 is cleaned in any one of the above embodiments, the present invention can be used for cleaning of an impression cylinder and other various cylinders which are used in printing and through which printing paper is passed.

What is claimed is:

1. A method for the cleaning of debris from the surface of a printing cylinder without the use of a cleaning liquid comprising:

a) rotating the printing cylinder;

b) providing a cylindrical brush having fibers bent in a zig-zag shape and inclined to the printing cylinder in all directions, c) brushing the surface of the rotating printing cylinder with the fibers of a cylindrical brush while said cylindrical brush is rotated in a direction opposite to the rotation of the printing cylinder to remove debris from the surface of the cylinder, wherein the brushing is carried out in the absence of a cleaning liquid.

2. The method of claim 1 wherein at least a portion of the removed debris is picked up by the brush and the rotating brush is contacted with a cleaning means to remove picked-up debris therefrom.

3. The method of claim 2 wherein the removal of debris from the cylinder surface and the removal off picked-up debris from the brush are carried out at the same time.

4. The method of claim 1 wherein the relative peripheral speed at the contact interface of the brush and the cylinder is from 5 to 12 meters per second.

5. An apparatus for cleaning debris from the surface of a rotating printing cylinder in the absence of a cleaning liquid comprising a) a cylindrical brush having multidirectionally oriented fibers, with the brush fibers bent to have a zigzag shape;

b) means for rotating the brush in a direction opposite to the direction of rotation of the printing cylinder;

c) means for contacting the fibers of the brush with the surface of the rotating printing cylinder; and d) means for stroking the fibers against the surface of the rotating printing cylinder in a direction opposite to the direction of rotation.

6. The apparatus of claim 5 having means for bringing the fibers of the brush into and out of contact with the surface of the cylinder.

* * * * *